US010811158B1

(12) United States Patent
Chen et al.

(10) Patent No.: US 10,811,158 B1
(45) Date of Patent: Oct. 20, 2020

(54) MULTI-MIRROR LASER SUSTAINED PLASMA LIGHT SOURCE

(71) Applicant: KLA Corporation, Milpitas, CA (US)

(72) Inventors: Qibiao Chen, Fremont, CA (US); Mark Shi Wang, San Ramon, CA (US)

(73) Assignee: KLA Corporation, Milpitas, CA (US)

( * ) Notice: Subject to any disclaimer, the term of this patent is extended or adjusted under 35 U.S.C. 154(b) by 0 days.

(21) Appl. No.: 16/516,512

(22) Filed: Jul. 19, 2019

(51) Int. Cl.
*G21K 1/06* (2006.01)
*H05H 1/46* (2006.01)

(52) U.S. Cl.
CPC ..... *G21K 1/06* (2013.01); *H05H 1/46* (2013.01)

(58) Field of Classification Search
USPC ..... 250/504 R
See application file for complete search history.

(56) References Cited

U.S. PATENT DOCUMENTS 5,608,526 A 3/1997 Piwonka-Corle et al.
5,999,310 A 12/1999 Shafer et al.
6,297,880 B1 10/2001 Rosencwaig et al.
7,525,649 B1 4/2009 Leong et al.
8,618,254 B2 12/2013 Giaccia et al.
2007/0002465 A1 1/2007 Chuang et al.
2009/0180176 A1 7/2009 Armstrong et al.
2013/0114085 A1 5/2013 Wang et al.
2016/0086788 A1* 3/2016 Blondia ..... H01J 61/35 313/111
2016/0381776 A1* 12/2016 Derstine ..... H05H 1/24 250/503.1
2017/0278694 A1* 9/2017 Chuang ..... H01J 61/54

* cited by examiner

*Primary Examiner* — Kiet T Nguyen
(74) *Attorney, Agent, or Firm* — Suiter Swantz pc llo

(57) ABSTRACT

A multi-mirror laser sustained plasma broadband light source is disclosed. The light source may include a gas containment structure for containing a gas. The light source includes a pump source configured to generate pump illumination and a first reflector element configured to direct a portion of the pump illumination into the gas to sustain a plasma. The first reflector is configured to collect a portion of broadband light emitted from the plasma. The light source also includes one or more additional reflector elements positioned opposite of the first reflector. The one or more additional reflector elements are configured to reflect unabsorbed pump illumination and broadband light uncollected by the first reflector element back to the plasma.

24 Claims, 15 Drawing Sheets

MULTI-MIRROR LASER SUSTAINED PLASMA LIGHT SOURCE

TECHNICAL FIELD

The present invention generally relates to a laser sustained plasma (LSP) broadband light source and, in particular, an LSP lamphouse with multiple reflector elements.

BACKGROUND

The need for improved light sources used for inspection of ever-shrinking semiconductor devices continues to grow. One such light source includes a laser sustained plasma (LSP) broadband light source. LSP broadband light sources include LSP lamps, which are capable of producing high-power broadband light. LSP lamps operate by using elliptical mirrors to focus laser radiation into a gas volume in order to ignite and/or sustain a plasma. Current elliptical mirrors have a large collection polar angle (e.g., 120 degree) and a low collection solid angle (e.g., less than $3\pi$), which results in low collection efficiency. Further, the focused spot size at the collection aperture is larger than ideal due to the large collection polar angle (e.g., 120-degree polar angle).

As such, it would be advantageous to provide a system and method to remedy the shortcomings of the conventional approaches identified above.

SUMMARY

A system is disclosed, in accordance with one or more embodiments of the present disclosure. In one embodiment, the system includes a gas containment structure for containing a gas. In another embodiment, the system includes a pump source configured to generate pump illumination. In another embodiment, the system includes a first reflector element configured to direct a portion of the pump illumination into the gas to sustain a plasma. In another embodiment, the first reflector is configured to collect at least a portion of broadband light emitted from the plasma. In another embodiment, the system includes one or more additional reflector elements positioned opposite of the first reflector. In another embodiment, a reflective surface of the first reflector element faces a reflective surface of the one or more additional reflector elements. In another embodiment, the one or more additional reflector elements are configured to reflect unabsorbed pump illumination and broadband light uncollected by the first reflector element back to the plasma.

A system is disclosed, in accordance with one or more embodiments of the present disclosure. In one embodiment, the system includes a gas containment structure for containing a gas. In another embodiment, the system includes a pump source configured to generate pump illumination. In another embodiment, the system includes an elliptical mirror configured to direct a portion of the pump illumination into the gas to sustain a plasma. In another embodiment, the elliptical mirror is configured to collect at least a portion of broadband light emitted from the plasma and direct the portion of broadband light to one or more downstream applications. In another embodiment, the system includes one or more spherical mirrors positioned above the elliptical mirror. In another embodiment, a reflective surface of the elliptical mirror faces a reflective surface of the one or more spherical mirrors. In another embodiment, the one or more spherical mirrors are configured to reflect unabsorbed pump illumination and broadband light uncollected by the elliptical mirror back to the plasma.

A method is disclosed, in accordance with one or more embodiments of the present disclosure. In one embodiment, the method includes generating pump illumination. In another embodiment, the method includes directing a portion of the pump illumination into a gas in a gas containment structure to sustain a plasma via a first reflector element. In another embodiment, the method includes collecting a portion of broadband light emitted from the plasma via the first reflector element and directing the portion of broadband light to one or more downstream applications. In another embodiment, the method includes reflecting unabsorbed pump illumination and broadband light uncollected by the first reflector element back to the plasma via one or more additional reflector elements.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 2A through 10, a multi-mirror laser sustained plasma broadband light source is described, in accordance with the present disclosure.

Figure 1:
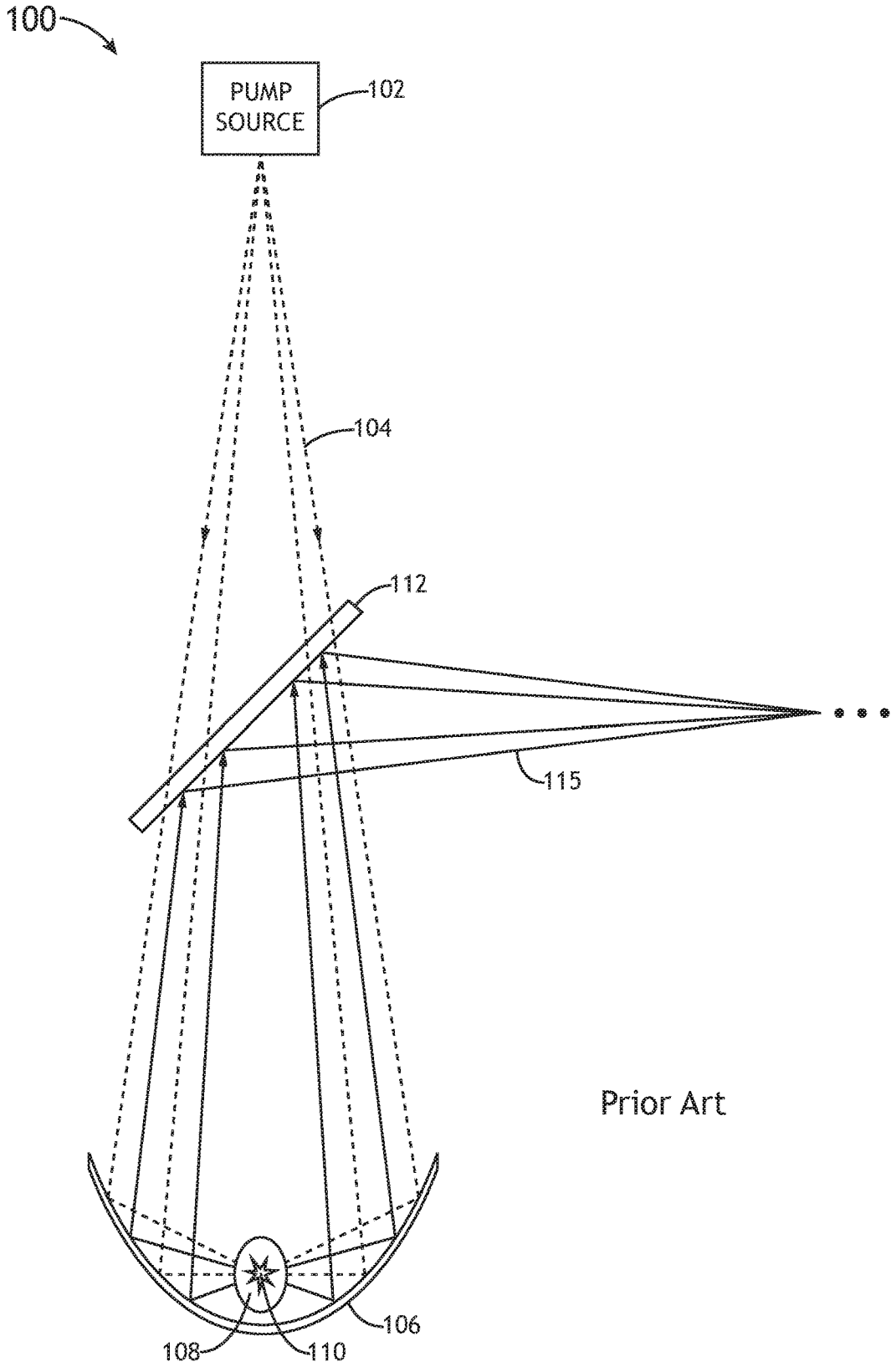
FIG. 1 is a schematic illustration of a conventional LSP broadband light source, in accordance with one or more embodiments of the present disclosure.

FIG. 1 is a schematic illustration of a conventional LSP broadband light source 100. The broadband light source 100 includes a pump source 102 configured to generate pump illumination 104 and an elliptical reflector element 106 configured to direct a portion of the pump illumination 104 to a gas contained in gas containment structure 108 to ignite and/or sustain a plasma 110. The elliptical reflector element 106 is configured to collect a portion of broadband light 115 emitted from the plasma 110 (e.g., lower $2\pi$ light). The broadband light 115 emitted from the plasma 110 may be collected via one or more additional optics (e.g., a cold mirror 112) for one or more downstream applications (e.g., inspection or metrology).

It is noted herein that the broadband light source 100 has a total collection angle of $3\pi$ (or less). The broadband light source 100 utilizes a 120-degree ellipse mirror (i.e., an elliptical mirror with a polar angle of 120 degrees) to collect broadband light 115 emitted from the plasma 110. However, such a source 100 has a large source etendue and the first reflector element requires high magnification. As a result of the large source etendue and high magnification, the focused spot size at the collection aperture is large and the collection efficiency is low. It is noted that the broadband light source 100 is not capable of recycling broadband radiation 115 emitted from the plasma, which causes the plasma to be heated via only a primary heat light source.

Based on the shortcomings of source 100, embodiments of the present disclosure are directed to a multi-mirror LSP broadband light source configured for increasing the total collection solid angle to greater than $3\pi$ (e.g. $3\pi$ to $4\pi$), which in turn increases the collection efficiency and decreases the focused spot size of the source. Increasing the collection efficiency may also lead to a 1.5× gain of light with the same laser power as the 120-degree polar angle source 100.

Figure 2A:
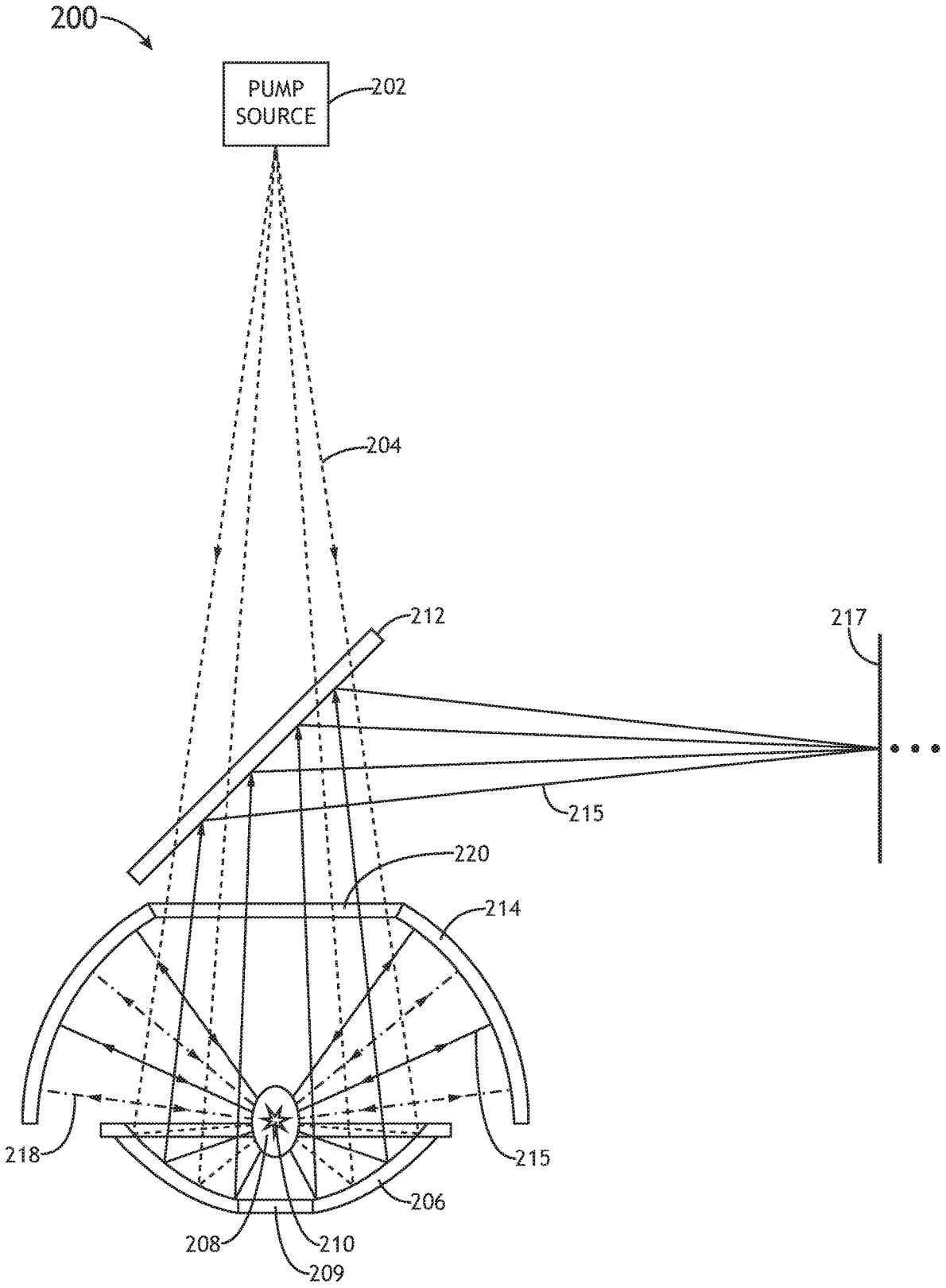
FIG. 2A is a schematic illustration of an LSP broadband light source, in accordance with one or more embodiments of the present disclosure.

FIG. 2A is a schematic illustration of an LSP broadband light source 200, in accordance with one or more embodiments of the present disclosure. In one embodiment, the broadband light source 200 includes one or more pump sources 202 for generating one or more beams of pump illumination 204. The one or more pump sources 202 may include any pump source known in the art suitable for igniting and/or sustaining plasma. For example, the one or more pump sources 202 may include one or more lasers (i.e., pump lasers). For instance, the one or more pump sources 202 may include at least one of an infrared (IR) laser, a visible laser, an ultraviolet (UV) laser, or the like.

In another embodiment, the broadband light source 200 includes a first reflector element 206 configured to focus a portion of the pump illumination 204 into a gas contained within a gas containment structure 208 at the focus of the first reflector element 206 to ignite and/or sustain a plasma 210.

In another embodiment, the first reflector element 206 has a collection polar angle less than 120 degrees. For example, the first reflector element 206 may have a collection polar angle of, or approximately, 90 degrees. It is noted herein that the collection angle shown in FIG. 2A is provided merely for illustrative purposes and shall not be construed as limiting the scope of the present disclosure.

In another embodiment, the broadband light source 200 includes one or more additional reflector elements 214 positioned opposite the first reflector element 206. For example, a reflective surface of the first reflector element 206 may face a reflective surface of the one or more additional reflector elements 214. The one or more additional reflector elements 214 may, but are not required to, be positioned above the first reflector element 206. It is noted herein that the one or more additional reflector elements 214 may be referred to as top reflector element(s) and the first reflector element 206 may be referred to as the bottom reflector element, however, such designation is non-limiting.

The one or more additional reflector elements 214 include one or more openings 220 configured to pass pump illumination 204 from the pump source 202 to the plasma 210 and/or from the focus of the first reflector element 206 to one or more components. For example, the one or more openings 220 may be configured to pass broadband light 215 to one or more additional optics (e.g., entrance aperture of optical characterization system or the like).

The first reflector element 206 and the one or more additional reflector elements 214 may include any reflector elements known in the art of plasma production. In one embodiment, the first reflector element 206 may include a reflective ellipsoid section (i.e., an elliptical reflector) and the one or more additional reflector elements 214 may include one or more spherical sections (i.e., spherical reflectors). It is noted herein that the first reflector element 206 and the one or more additional reflector elements 214 are not limited to an elliptical reflector and spherical reflector, respectively. Rather, the first reflector element 206 and the one or more additional reflector elements 214 may include any reflector shapes known in the art of plasma production. For example, the first reflector element 206 and/or the one or more additional reflector elements 214 may include one or more elliptical reflectors, one or more spherical reflectors, and/or one or more parabolic reflectors.

In one embodiment, the one or more additional reflector elements 214 include a single reflective spherical section 214. The single reflective spherical section may be centered at a foci of the first reflector element 206.

In another embodiment, the first reflector element 206 has a radius of curvature smaller than the one or more additional reflector elements 214. For example, the first reflector element 206 may have a radius of curvature R1, which is smaller than a radius of curvature R2 of the one or more additional reflector elements 214. For instance, the first reflector element 206 may have a radius of curvature R1=100 mm, while the one or more additional reflector elements 214 may have a radius of curvature R2=160 mm. It is noted herein that the one or more additional reflector elements 214 may have any conic constant k known in the art. For example, the one or more additional reflector elements 214 may have a conic constant k=0 (i.e., a spherical mirror). By way of another example, the one or more additional reflector elements 214 may have a conic constant k=−1 (i.e., a parabolic mirror).

In one embodiment, the first reflector element 206 and the one or more additional reflector elements 214 are configured such that they have a combined collection solid angle between 3π and 4π. For example, the first reflector element 206 and the one or more additional reflector elements 214 may have a combined collection solid angle between 3.4π and 3.6π. For instance, the first reflector element 206 and the one or more additional reflector elements 214 have a combined collection solid angle of 3.5π. It is noted herein that the emission solid angle (e.g., near 4π) of the plasma light source is divided into upper 2π and lower 2π.

Figure 2B:
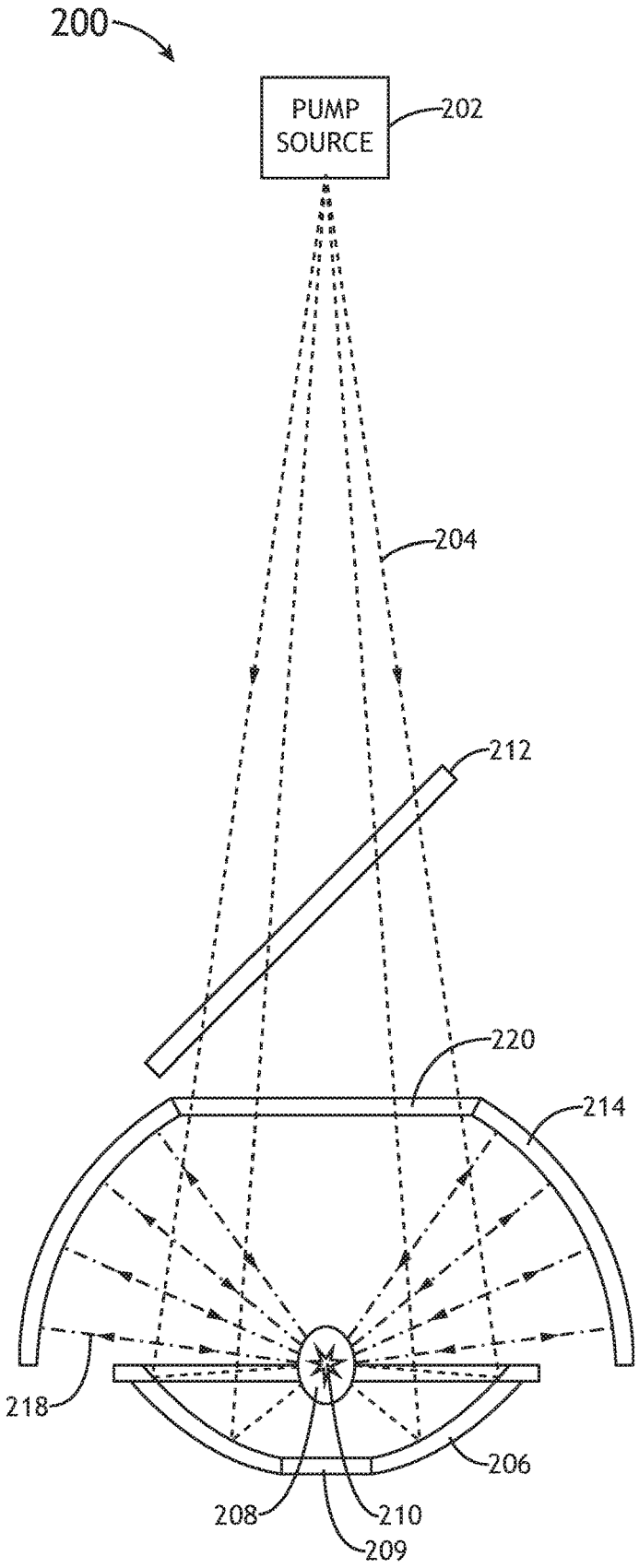
FIG. 2B is a schematic illustration of one or more pump sources of an LSP broadband light source sustaining and heating a plasma, in accordance with one or more embodiments of the present disclosure.

FIG. 2B is a schematic illustration of the one or more pump sources 202 of the LSP broadband light source 200 sustaining and heating the plasma 210, in accordance with one or more embodiments of the present disclosure. For purposes of simplicity, the broadband light 215 emitted from the plasma 210 are not depicted in FIG. 2B.

As shown in FIG. 2B, the one or more pump sources 202 are arranged at one of the foci of the first reflector element 206 and the pump illumination 204 from the pump source 202 is focused to a second foci of the first reflector element 206 to sustain the plasma 210. The one or more additional reflector elements 214 may be configured to reflect unabsorbed pump illumination 218 back to the plasma 210 at the foci of the first reflector element 206. In this embodiment, the refocused pump illumination 218 may have an additional opportunity to be absorbed by the plasma 210, thereby further heating the plasma 210 and increasing efficiency of the source 200.

Figure 2C:
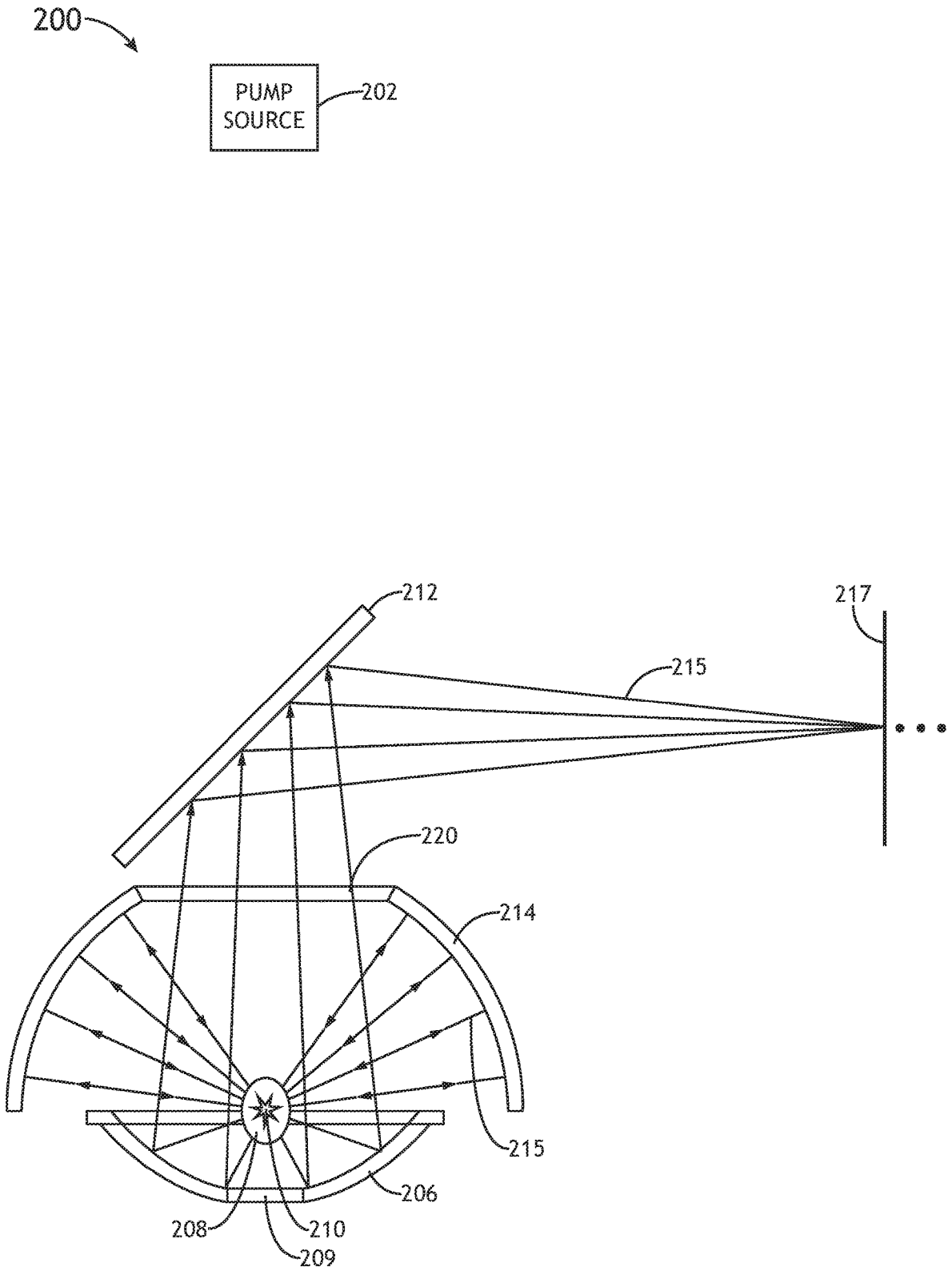
FIG. 2C is a schematic illustration of light collection in an LSP broadband light source, in accordance with one or more embodiments of the present disclosure.

FIG. 2C is a schematic illustration of light collection in the LSP broadband light source 200, in accordance with one or more embodiments of the present disclosure. For purposes of simplicity, the initial pump illumination 204 and the recycled pump illumination 218 are not depicted in FIG. 2C. The first reflector element 206 may be configured to collect lower 2π light for use in downstream applications. For example, the first reflector element 206 may focus the lower 2π light to a second foci of the first reflector element 206.

Referring again to FIG. 2A, during operation, the plasma 210 absorbs a portion of the pump illumination 204, 218 and emits broadband light 215. In this embodiment, approximately half of the broadband light 215 is re-focused back to the plasma 210 at the first reflector element 206 foci to provide additional heating power for the plasma 210. It is noted that at least a portion of the light emitted to the upper 2π solid angle (i.e., upper 2π broadband light 215 and upper 2π unabsorbed pump illumination 218) is recycled continuously to help boost the effective usage of the photon energy to heat up the plasma 210. In this embodiment, the one or more additional reflector elements 214 are configured to collect upper 2π light, which was uncollected by the first reflector element 206. For example, the broadband light 215 emitted to the upper 2π solid angle is first focused back to the focus (e.g., where the plasma 210 is located) of both the first reflector element 206 and the one or more additional reflector elements 214. In this example, the first reflector element 206 may then relay broadband light 215 refocused back to the first reflect element 206 from the one or more additional reflector elements 214 to the second foci (e.g., location of collection aperture) of the first reflector element 206. It is noted herein that in this embodiment the upper 2π and lower 2π light may be collected within the same collection etendue, which results in an increased collection solid angle (e.g., near 4π).

In some embodiments, the pump illumination 204 includes IR light. In this embodiment, the IR light focused to the plasma 210 occupies a 2π solid angle. For example, a significant portion of the IR light is absorbed by the plasma 210 on its first path through the plasma 210, while the remaining IR light propagates through the plasma 210 and is refocused to the plasma 210 by the top reflector element(s) 214. Additionally, a significant portion of the returned IR light is re-absorbed by the plasma 210 again, leaving a very small portion of the IR light leaked out the broadband light source 200. In this embodiment, the one or more additional optics may include a cold mirror 212 configured to reflect a spectrum of interest of the broadband light 215 from the plasma 210 to a plasma collection plane 217, while the other portion of the light spectrum (including the unabsorbed pump illumination) transmits through the cold mirror 212. It is noted herein that this process increases the overall IR absorption efficiency via double absorption.

The gas containment structure 208 may include any gas containment structure known in the art including, but not limited to, a plasma/gas bulb, plasma/gas cell, plasma/gas chamber, or like. Further, the gas contained within the gas containment structure 208 may include any gas known in the art including, but not limited to, at least one of argon (Ar), krypton (Kr), xenon (Xe), neon (Ne), nitrogen ($N_2$), or the like.

In one embodiment, the broadband light source 200 includes an open access hole 209 configured to allow insertion of a lamp (e.g., plasma cell or plasma bulb). For example, the gas containment structure 208 of the light source 200 may include an open access hole 209. By way of another example, the first reflector element 206 may include an open access hole 209. It is noted herein that, in the case where the gas containment structure 208 is a plasma bulb or a plasma cell, the transparent portions (e.g., glass) of the gas containment structure 208 may take on any number of shapes. For example, the gas containment structure 208 may have a cylindrical shape, a spherical shape, a cardioid shape, or the like.

The first reflector element 206 and the one or more additional reflector elements 214 are configured to collect any wavelength of broadband light from the plasma 210 known in the art of plasma-based broadband light sources. For example, the first reflector element 206 and the one or more additional reflector elements 214 may be configured to collect ultraviolet (UV) light, vacuum UV (VUV) light, deep UV (DUV) light, and/or extreme UV (EUV) light.

In another embodiment, the broadband light source 200 further includes one or more additional optics configured to direct the broadband light output 215 from the plasma 210 to one or more downstream applications (indicated by the ellipsis in FIGS. 2A through 2C). The one or more additional optics may include any optical element known in the art including, but not limited to, one or more mirrors, one or more lenses, one or more filters, one or more beam splitters, or the like.

Figure 2D:
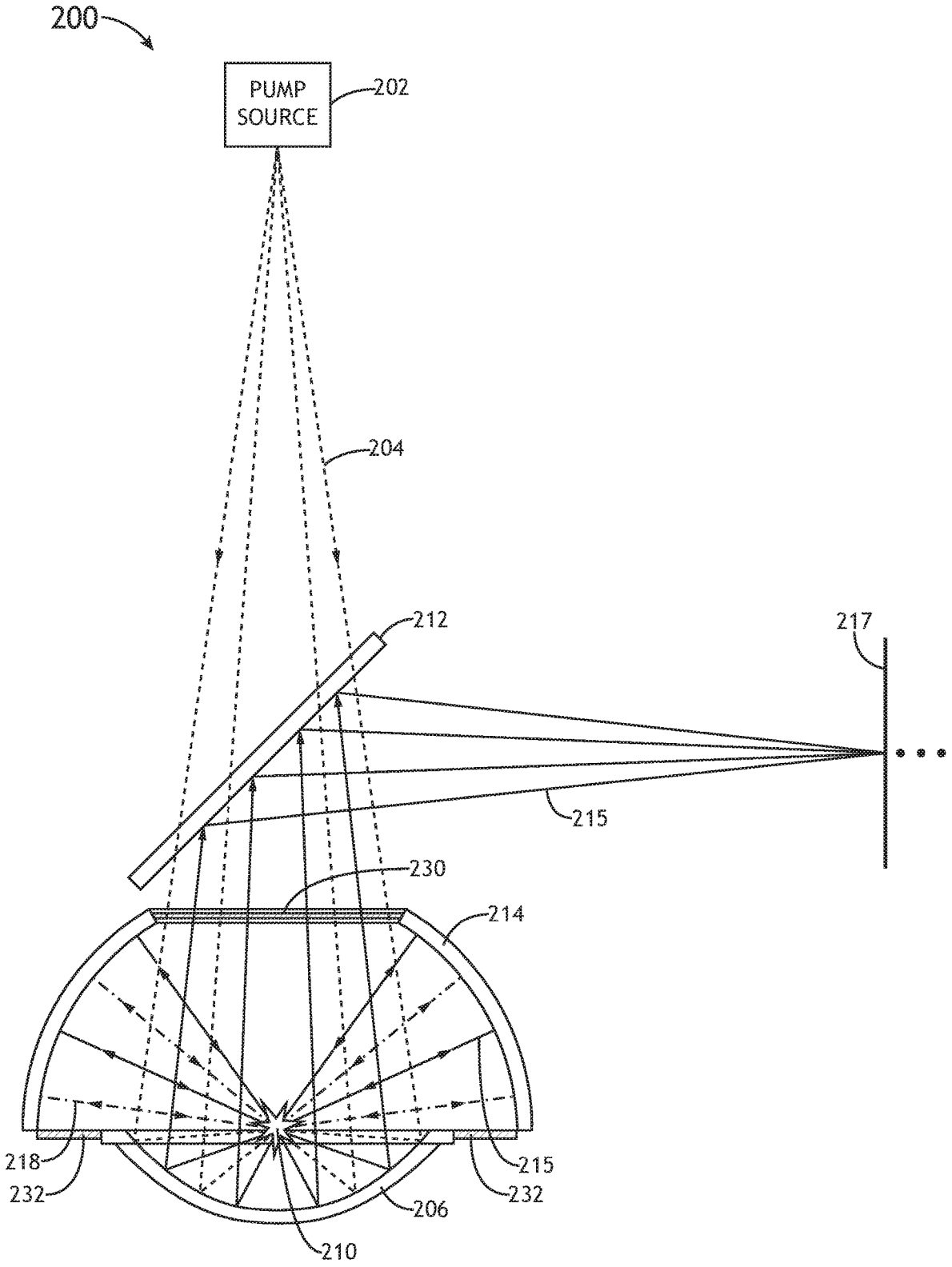
FIG. 2D is a schematic illustration of an LSP broadband light source including a first reflector element and one of the one or more additional reflector elements configured to form a gas containment structure.

While many of the embodiments of the present disclosure have been shown to have a plasma cell or plasma bulb, such as embodiments shown in FIG. 2A, such a configuration should not be interpreted as a limitation on the scope of the present disclosure. In one or more alternative embodiments, as shown in FIG. 2D, the first reflector element 206 and one of the one or more additional reflector elements 214 may be configured to form the gas containment structure 208 itself. For example, the first reflector element 206 and the one or more additional reflector elements 214 may be sealed so to contain the gas within the volume defined by the surfaces of the first reflector element 206 and the one or more additional reflector elements 214. In this example, an internal gas containment structure, such as plasma cell or plasma bulb is not needed, with the surfaces of the first reflector element 206 and the one or more additional reflector elements 214 acting as a gas chamber. In this case, the opening 220 will be sealed with a window 230 (e.g., glass window) to allow both the pump light 204 and plasma broadband light 215 to pass through it. In one embodiment, the first reflector element 206 may be constructed without an opening 209. The opening between the first reflector element 206 and the additional reflector element 214 may be sealed off with seals 232.

Figure 3A:
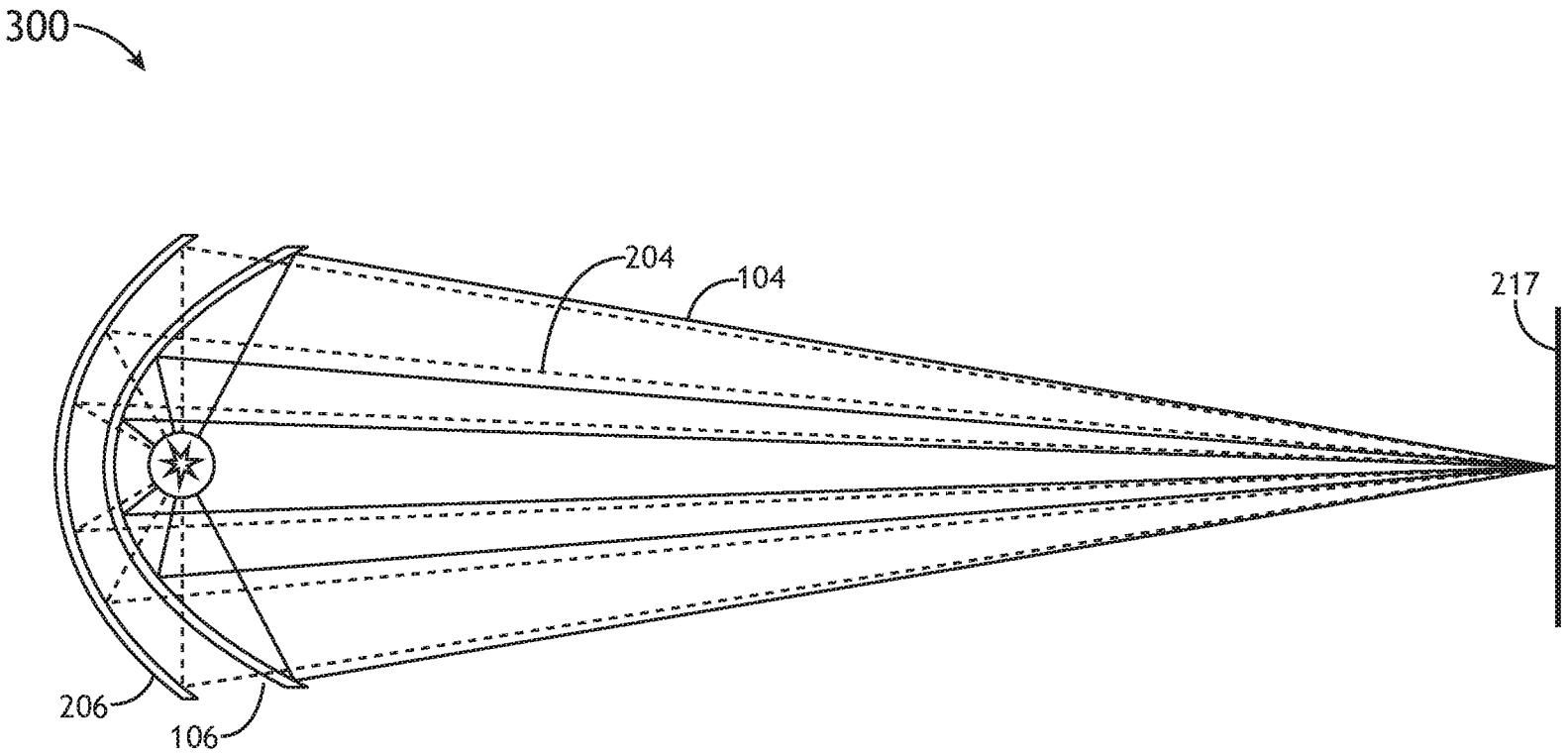
FIG. 3A illustrates a graph comparing an LSP broadband source shown in FIG. 1 and an LSP broadband light source shown in FIG. 2A, in accordance with one or more embodiments of the present disclosure.

FIG. 3A illustrates a graph 300 comparing the broadband source 100 and the broadband light source 200. In this example, the reflector element 106 of source 100 has a larger collection angle than the first reflector element 206 of broadband light source 200. For example, the first reflector element 106 of source 100 may have a 120-degree collection polar angle, while the first reflector element 206 of the broadband light source 200 may have a 90-degree collection polar angle. Further, in this example, the collection numerical aperture (NA) of downstream optics in collection plane 217 is the same for both the source 100 and the source 200.

Figure 3B:
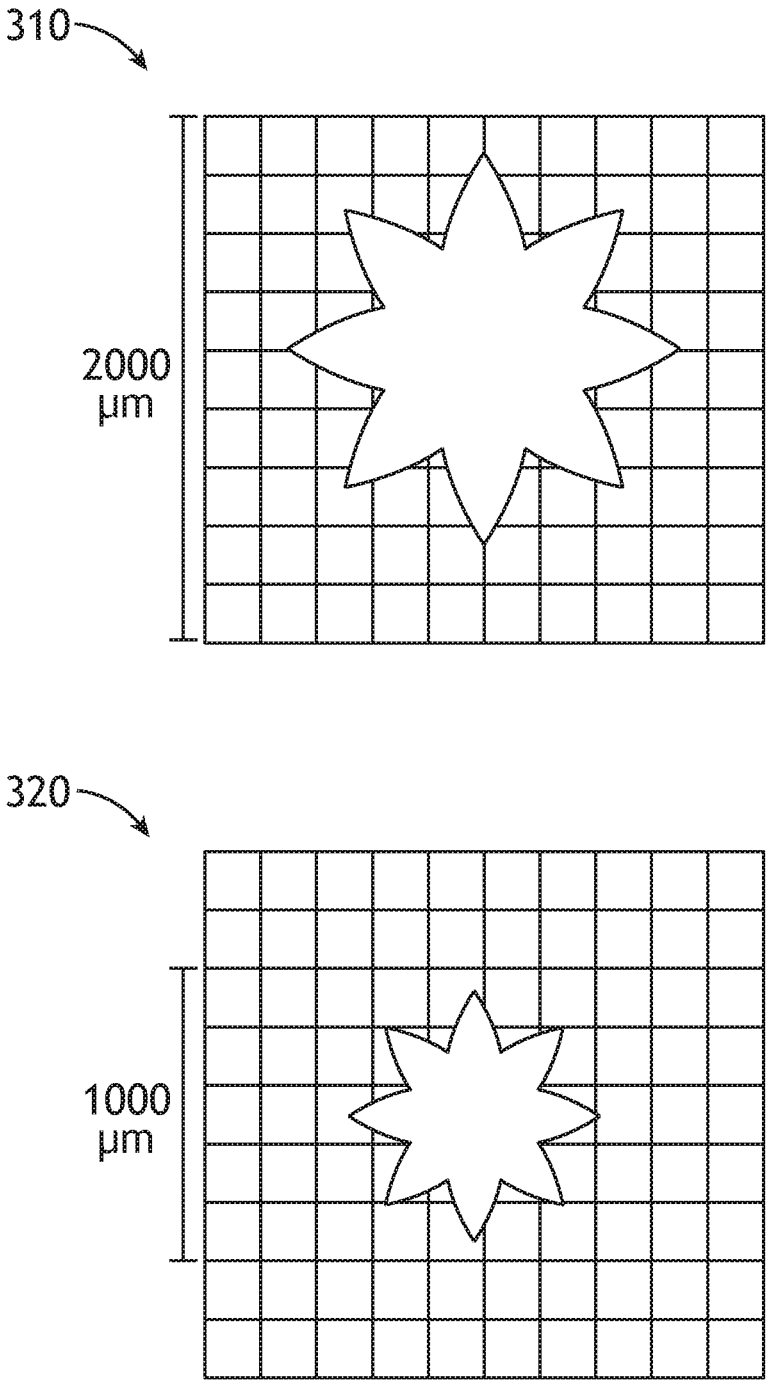
FIG. 3B is an illustration of focused spots corresponding to an LSP broadband light source shown in FIG. 1 and an LSP broadband light source shown in FIG. 2A, in accordance with one or more embodiments of the present disclosure.

FIG. 3B is an illustration of focused spots 310, 320 corresponding to the broadband light source 100 and the broadband light source 200, respectively, in accordance with one or more embodiments of the present disclosure. In one embodiment, the reflector element 106 of the source 100 produces focused spot 310 and the first reflector element 206 of the broadband light source 200 produces focused spot 320. In this example, the focused spot 310 of the broadband light source 100 is larger (e.g., approximately 2000 μm) than the focused spot 320 of the broadband light source 200 (e.g., approximately 1000 μm) due to the larger collection polar angle (e.g., 120 degrees) of source 100 (relative to source 200). It is noted herein that the smaller size of the spot 320 of the broadband light source 200 allows the broadband light source 200 to display a higher collection efficiency (e.g., at or near 4π for the broadband light source 200 and 3π for the source 100).

Figure 3C:
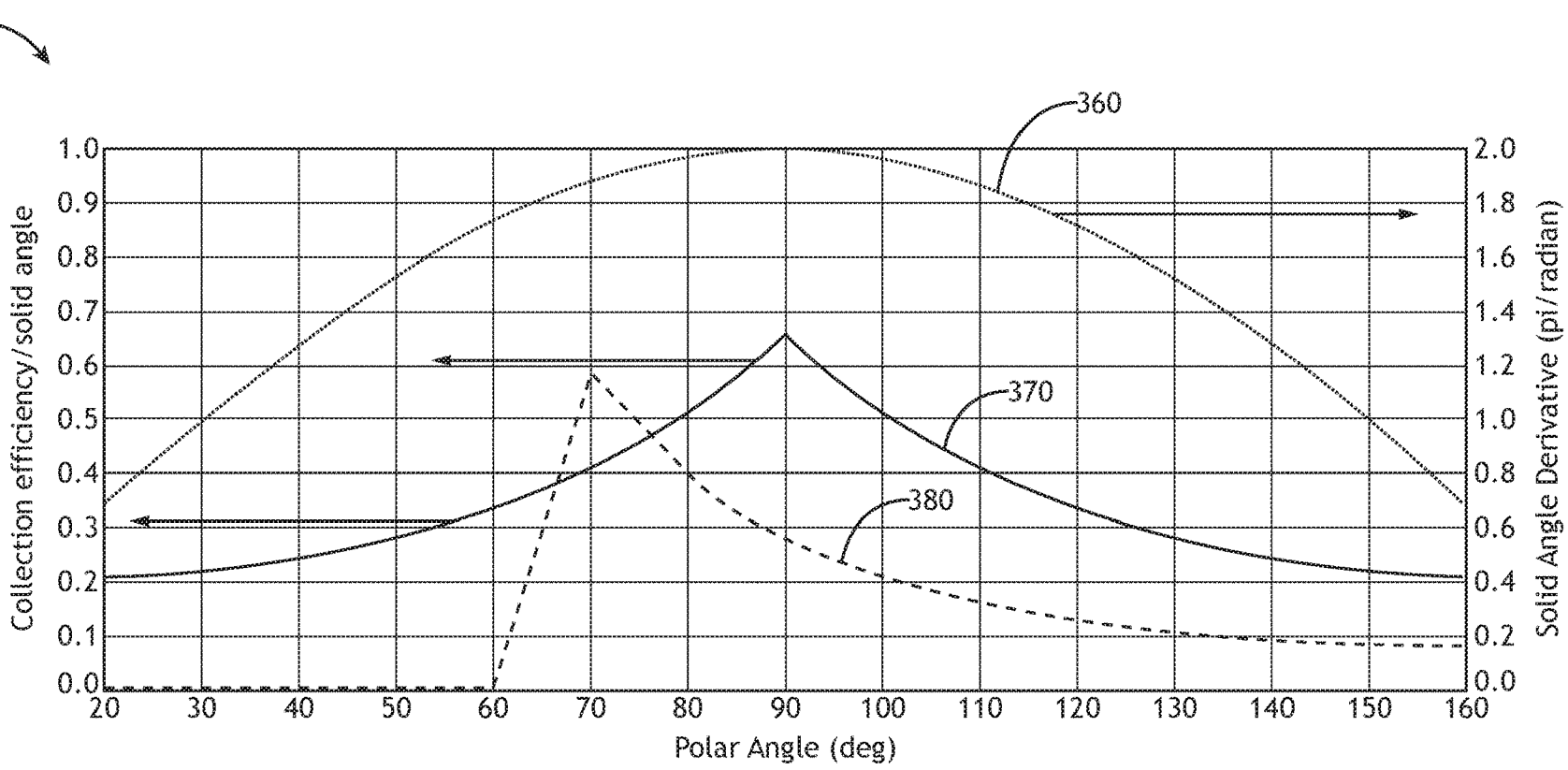
FIG. 3C is a graph depicting the collection light efficiency of an LSP broadband light source shown in FIG. 1, the collection light efficiency of an LSP broadband light source shown in FIG. 2A, and the solid angle derivative of an LSP broadband light source shown in FIG. 2A as a function of polar emission angle, in accordance with one or more embodiments of the present disclosure.

FIG. 3C is a graph 350 depicting the collection light efficiency 380 of the source 100, the collection light efficiency 370 of the broadband light source 200, and the solid angle derivative 360 of both the light sources 100 and 200 as a function of polar emission angle, in accordance with one or more embodiments of the present disclosure.

In one embodiment, the solid angle derivative 360 of the light source 200 shown in graph 350 is the derivative of solid angle versus polar angle. In this embodiment, the solid angle derivative 360 reaches a maximum at polar angle ψ=90 degree.

In another embodiment, the graph 350 illustrates the collection efficiency 370 per solid angle of the light source 200 and the collection efficiency 380 per the solid angle of the light source 100. In this embodiment, the collection efficiency 370, 380 are a function of polar emission angle for the new and old design, respectively. Further, the collection efficiency per solid angle is higher for the new design (the collection efficiency 370) vs the old design (the collection efficiency 380) at almost all of the polar angles. In the new design, the collection efficiency 370 per solid angle reaches maximum at polar angle ψ=90 degree, where the solid angle has the highest derivative. On the other hand, in the old design, the maximum collection efficiency 380 per solid angle reaches maximum at a polar angle where the solid angle derivative is not at its maximum. Therefore, the overall collection efficiency for the new design is higher than that of previous approaches.

Figure 4:
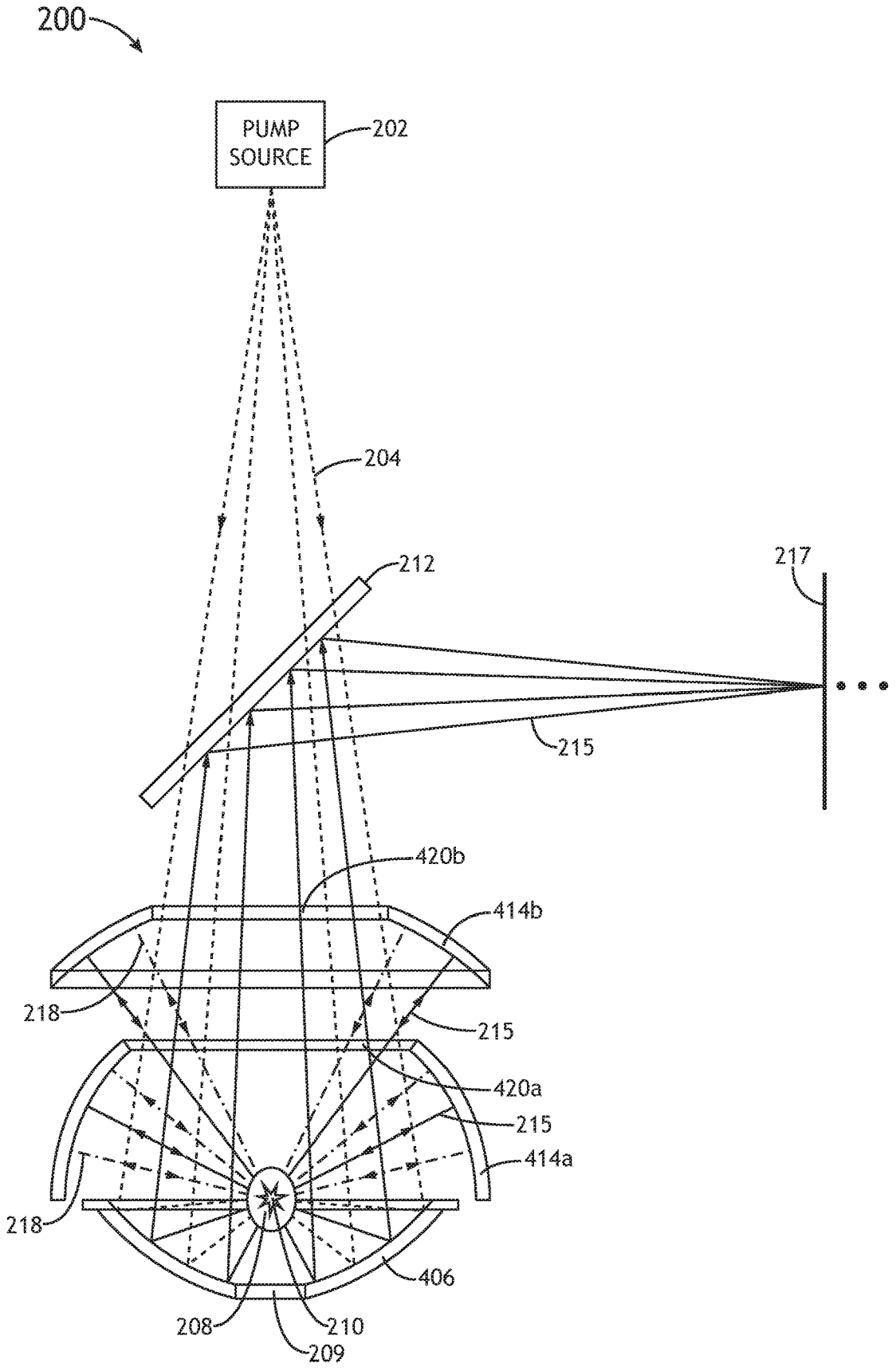
FIG. 4 is a schematic illustration of an LSP broadband light source with two additional reflector elements in a stacked configuration, in accordance with one or more embodiments of the present disclosure.

FIG. 4 is a schematic illustration of an LSP broadband light source 400 with two additional reflector elements in a stacked configuration, in accordance with one or more embodiments of the present disclosure. In one embodiment, the one or more additional reflector elements includes a first reflective spherical section 414*a* and a second spherical section 414*b*. The first reflective spherical section 414*a* and the second spherical section 414*b* may be co-centered at a foci of the first reflector element 406. Such a double-mirror construction increases the collection solid angle of the source, as the second section 414*b* is able to collect upper 2π light that was uncollected by the first section. Further, such a double-mirror construction reduces the lateral diameter for manufacturability of the larger reflective spherical section.

The first reflective spherical section 414*a* and the second spherical section 414*b* may include one or more openings 420 configured to allow the pump illumination 204 to pass through the spherical sections 414*a*, 414*b* and further configured to pass broadband light 215 to one or more downstream components. For example, the second spherical section 414*b* may include a second opening 420*b* configured pass pump illumination 204 from the pump source 202 through a first opening 420*a* of the first spherical section 414*a* to the plasma 210. Further, the first opening 420*a* may be configured to pass collected broadband light 215 from the focus of the first reflector element 406 through the second opening 420*b* to one or more components. Moreover, the second spherical section 414*b* may provide additional recycling of the pump illumination 218 and the broadband light 215.

In one embodiment, the radius of curvature of the second spherical section 414*b* is greater than a radius of curvature of the first spherical section 414*a*. Further, at least one of the first spherical section 414*a* or the second spherical section 414*b* has a radius of curvature larger than a radius of curvature of the first reflector element 406.

Figure 5:
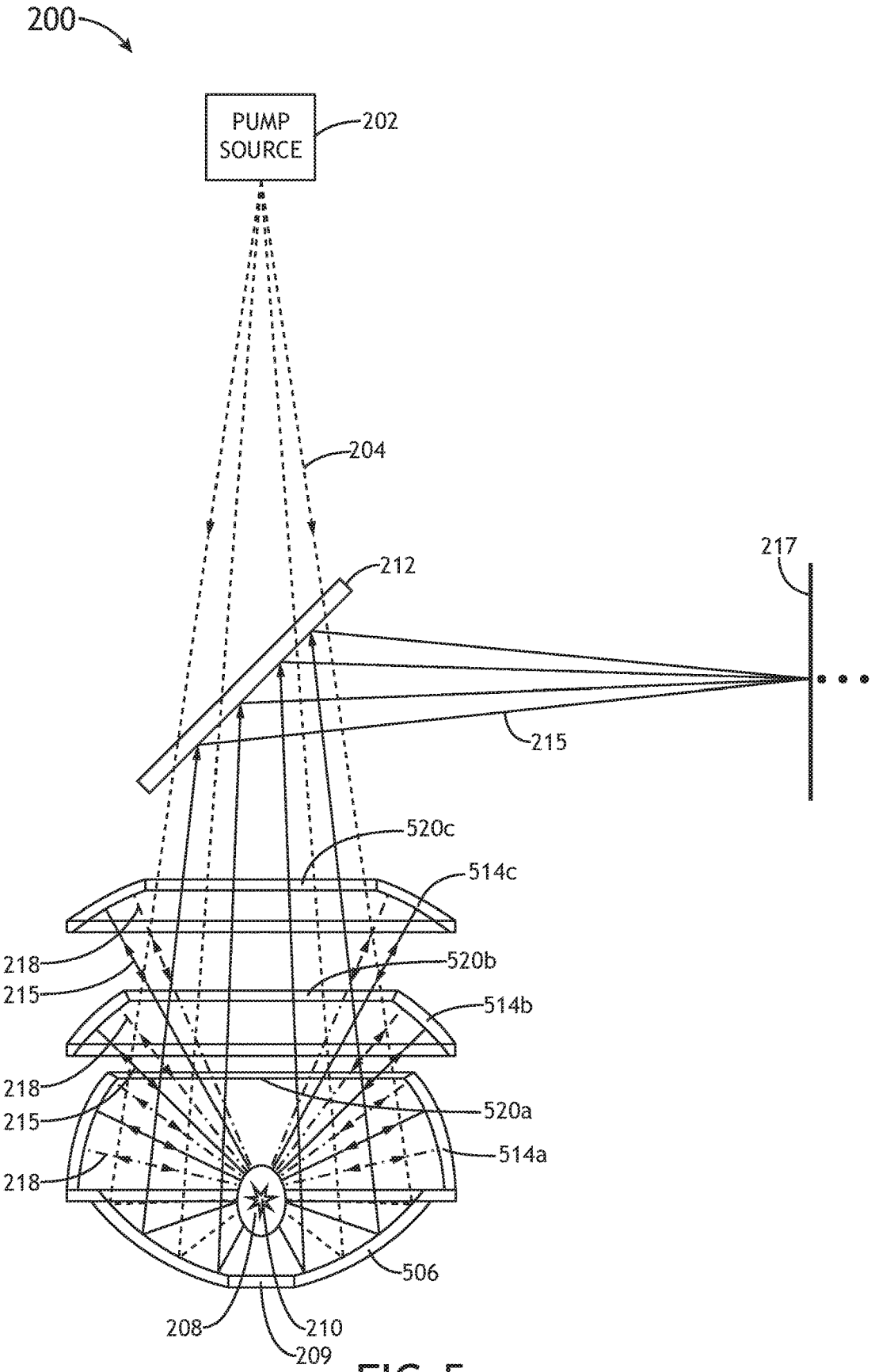
FIG. 5 is a schematic illustration of an LSP broadband light source with three additional reflector elements in a stacked configuration, in accordance with one or more embodiments of the present disclosure.

FIG. 5 is a schematic illustration of an LSP broadband light source 500 with three additional reflector elements 514 in a stacked configuration, in accordance with one or more embodiments of the present disclosure. In one embodiment, the one or more reflector elements includes a first reflective spherical section 514*a*, a second spherical section 514*b*, and a third spherical section 514*c*. The first reflective spherical section 514*a*, the second spherical section 514*b*, and the third spherical section 514*c* may be co-centered at a focus of the first reflector element 506.

The first reflective spherical section 514*a*, the second spherical section 514*b*, and the third spherical section 514*c* may include one or more openings 520 configured to allow the pump illumination 204 to pass through the spherical sections 514*a*, 514*b*, and 514*c* and further configured to pass broadband light 215 to one or more downstream components. For example, the third spherical section 514*c* may include a third opening 520*c*, the second spherical section 514*b* may include a second opening 520*b*, and the first spherical section 514*a* may include a first spherical opening 520*a*. In this regard, the second spherical section 514*b* may provide additional recycling of pump illumination 218 and broadband light 215 for light that is uncollected by the first reflector element 506, while the third spherical section 514*c* provides recycling of pump illumination 218 that is uncollected by the second spherical section 514*b*. In another embodiment, the radius of curvature of the third spherical section 514*c* is greater than the radius of curvature of the second spherical section 514*b* and the first spherical section 514*a*.

It is noted herein that the stacked configuration of the multiple additional reflector elements as shown in FIGS. 4 and 5 allows one to reduce the size of the additional reflector elements 414*a*-414*b* and 514*a*-514*c*. This reduction in size improves the collection efficiency of one or more embodiments of the present disclosure. Additionally, this reduction in mirror size improves the manufacturability of the mirrors that allow a larger collection solid angle for higher collection efficiency.

It is further noted that, while the maximum number of additional reflector elements in source 200 has been shown as three, this should not be interpreted as a limitation on the scope of the present disclosure. For example, the source 200 may be equipped with any number of additional reflector elements including, but not limited to, one, two, three, four, five, or six additional reflector elements (and so on).

Figure 6:
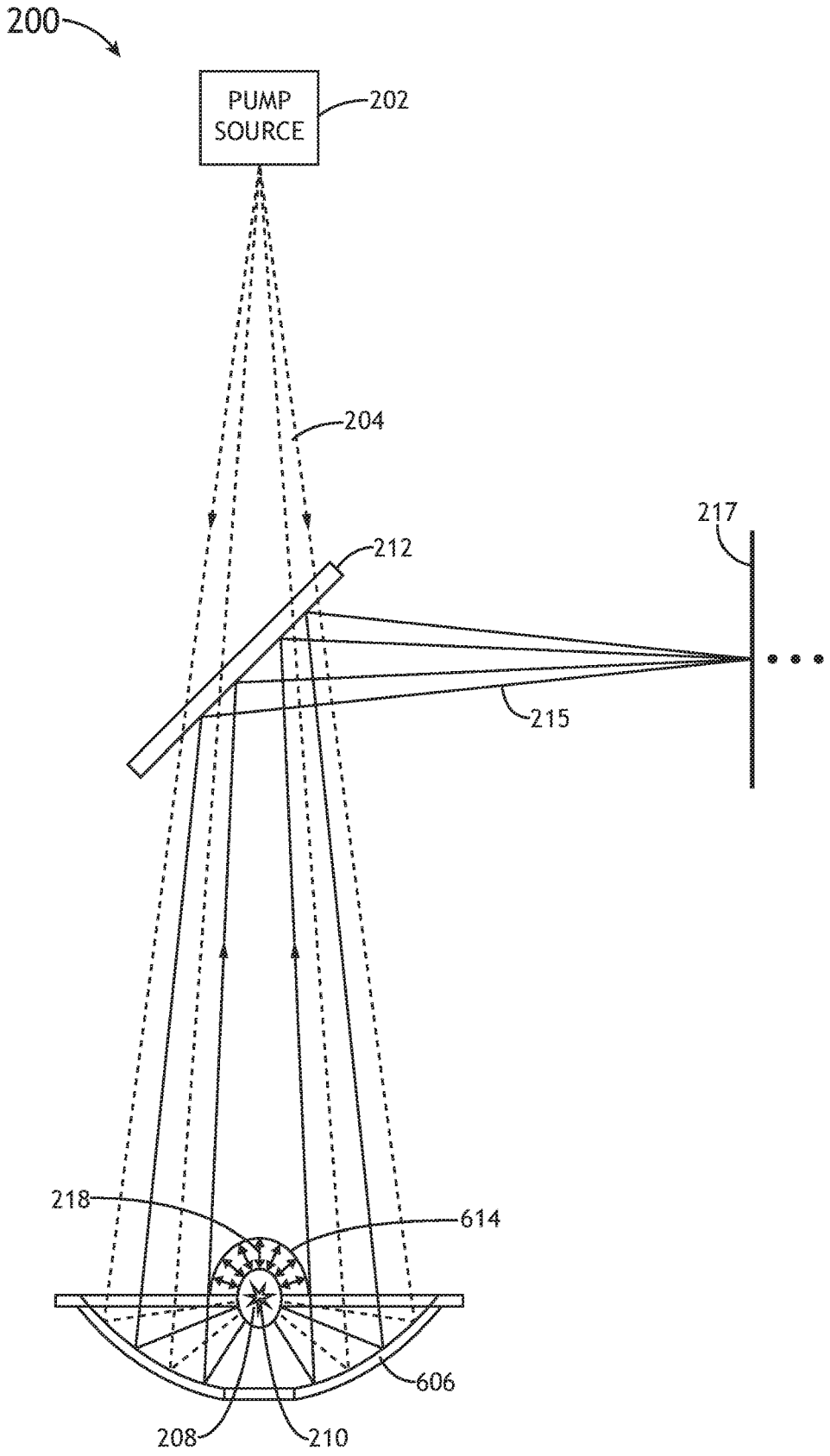
FIG. 6 is a schematic illustration of an LSP broadband light source, in accordance with one or more embodiments of the present disclosure.

FIG. 6 is a schematic illustration of the broadband light source 200, in accordance with one or more alternative and/or additional embodiments of the present disclosure.

In this embodiment, a first reflector element 606 has a radius of curvature larger than a radius of curvature of the one or more additional reflector elements 614. In this embodiment, the one or more additional reflector elements 614 are arranged in a shadow of pump illumination 204 and a collection pathway 217. Further, in this embodiment, the one or more additional reflector elements 614 are configured to refocus the plasma broadband radiation 215 back to the plasma 610.

Figure 7:
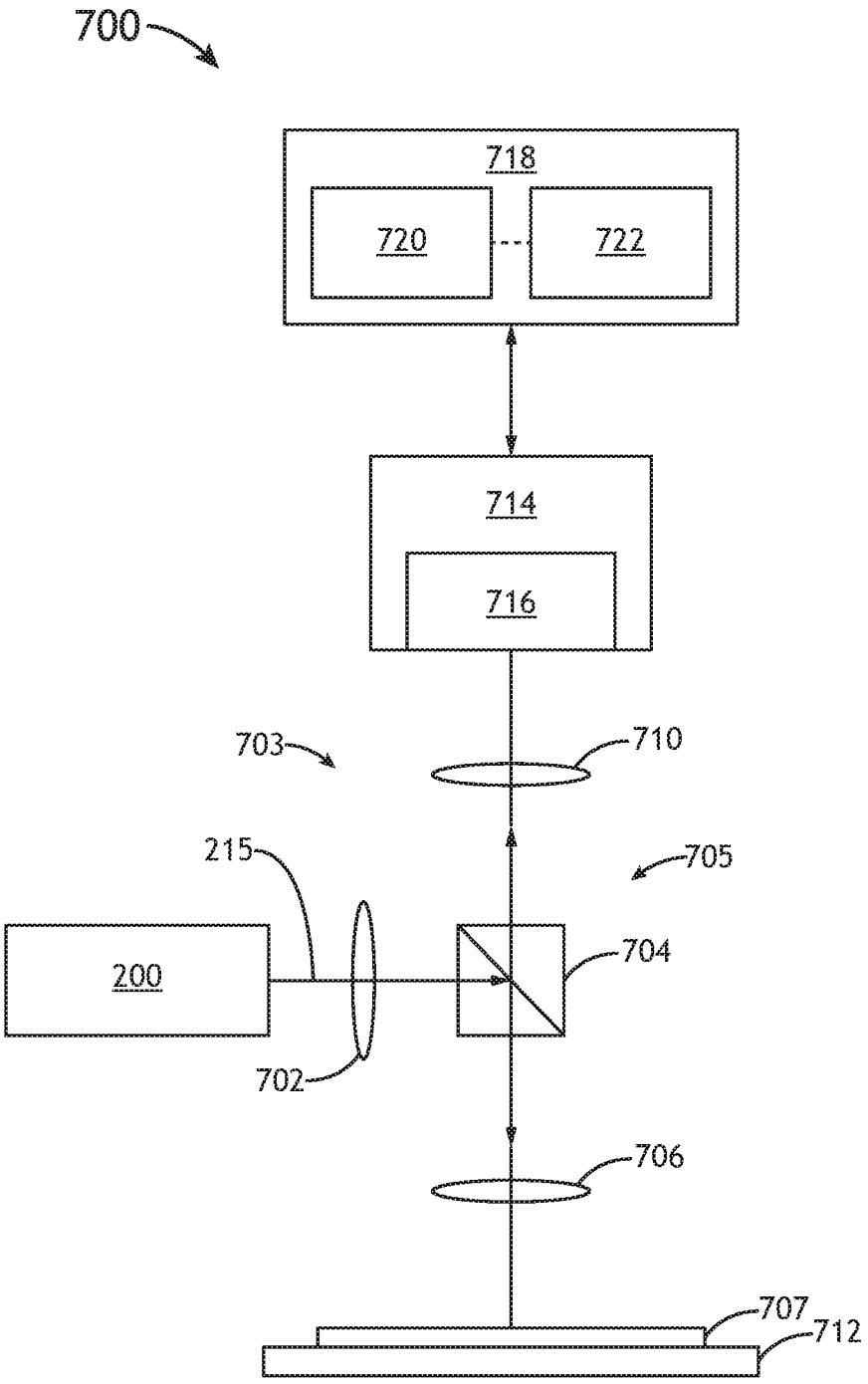
FIG. 7 is a schematic illustration of an optical characterization system implementing an the LSP broadband light source illustrated in any of FIGS. 2A through 6 (or any combination thereof) in accordance with one or more embodiments of the present disclosure.

FIG. 7 is a schematic illustration of an optical characterization system 700 implementing the LSP broadband light source 200 illustrated in any of FIGS. 2A through 6 (or any combination thereof), in accordance with one or more embodiments of the present disclosure.

It is noted herein that system 700 may comprise any imaging, inspection, metrology, lithography, or other characterization/fabrication system known in the art. In this regard, system 700 may be configured to perform inspection, optical metrology, lithography, and/or imaging on a specimen 707. Specimen 707 may include any sample known in the art including, but not limited to, a wafer, a reticle/photomask, and the like. It is noted that system 700 may incorporate one or more of the various embodiments of the LSP broadband light source 200 described throughout the present disclosure.

In one embodiment, specimen 707 is disposed on a stage assembly 712 to facilitate movement of specimen 707. The stage assembly 712 may include any stage assembly 712 known in the art including, but not limited to, an X-Y stage, an R-θ stage, and the like. In another embodiment, stage assembly 712 is capable of adjusting the height of specimen 707 during inspection or imaging to maintain focus on the specimen 707.

In another embodiment, the illumination arm 703 is configured to direct illumination from the broadband light source 200 to the specimen 707. The illumination arm 703 may include any number and type of optical components known in the art. In one embodiment, the illumination arm 703 includes one or more optical elements 702, a beam splitter 704, and an objective lens 706. In this regard, illumination arm 703 may be configured to focus illumination from the LSP broadband light source 200 onto the surface of the specimen 707. The one or more optical elements 702 may include any optical element or combination of optical elements known in the art including, but not limited to, one or more mirrors, one or more lenses, one or more polarizers, one or more gratings, one or more filters, one or more beam splitters, and the like.

In another embodiment, the collection arm 705 is configured to collect light reflected, scattered, diffracted, and/or emitted from specimen 707. In another embodiment, collection arm 705 may direct and/or focus the light from the specimen 707 to a sensor 716 of a detector assembly 714. It is noted that sensor 716 and detector assembly 714 may include any sensor and detector assembly known in the art. For example, the sensor 716 may include, but is not limited to, a charge-coupled device (CCD) detector, a complementary metal-oxide semiconductor (CMOS) detector, a time-delay integration (TDI) detector, a photomultiplier tube (PMT), an avalanche photodiode (APD), and the like. Further, sensor 716 may include, but is not limited to, a line sensor or an electron-bombarded line sensor.

In another embodiment, detector assembly 714 is communicatively coupled to a controller 718 including one or more processors 720 and memory 722. For example, the one or more processors 720 may be communicatively coupled to memory 722, wherein the one or more processors 720 are configured to execute a set of program instructions stored on memory 722. In one embodiment, the one or more processors 720 are configured to analyze the output of detector assembly 714. In one embodiment, the set of program instructions are configured to cause the one or more processors 720 to analyze one or more characteristics of specimen 707. In another embodiment, the set of program instructions are configured to cause the one or more processors 720 to modify one or more characteristics of system 700 in order to maintain focus on the specimen 707 and/or the sensor 716. For example, the one or more processors 720 may be configured to adjust the objective lens 706 or one or more optical elements 702 in order to focus illumination from LSP broadband light source 200 onto the surface of the specimen 707. By way of another example, the one or more processors 720 may be configured to adjust the objective lens 706 and/or one or more optical elements 702 in order to collect illumination from the surface of the specimen 707 and focus the collected illumination on the sensor 716.

It is noted that the system 700 may be configured in any optical configuration known in the art including, but not limited to, a dark-field configuration, a bright-field orientation, and the like.

Figure 8:
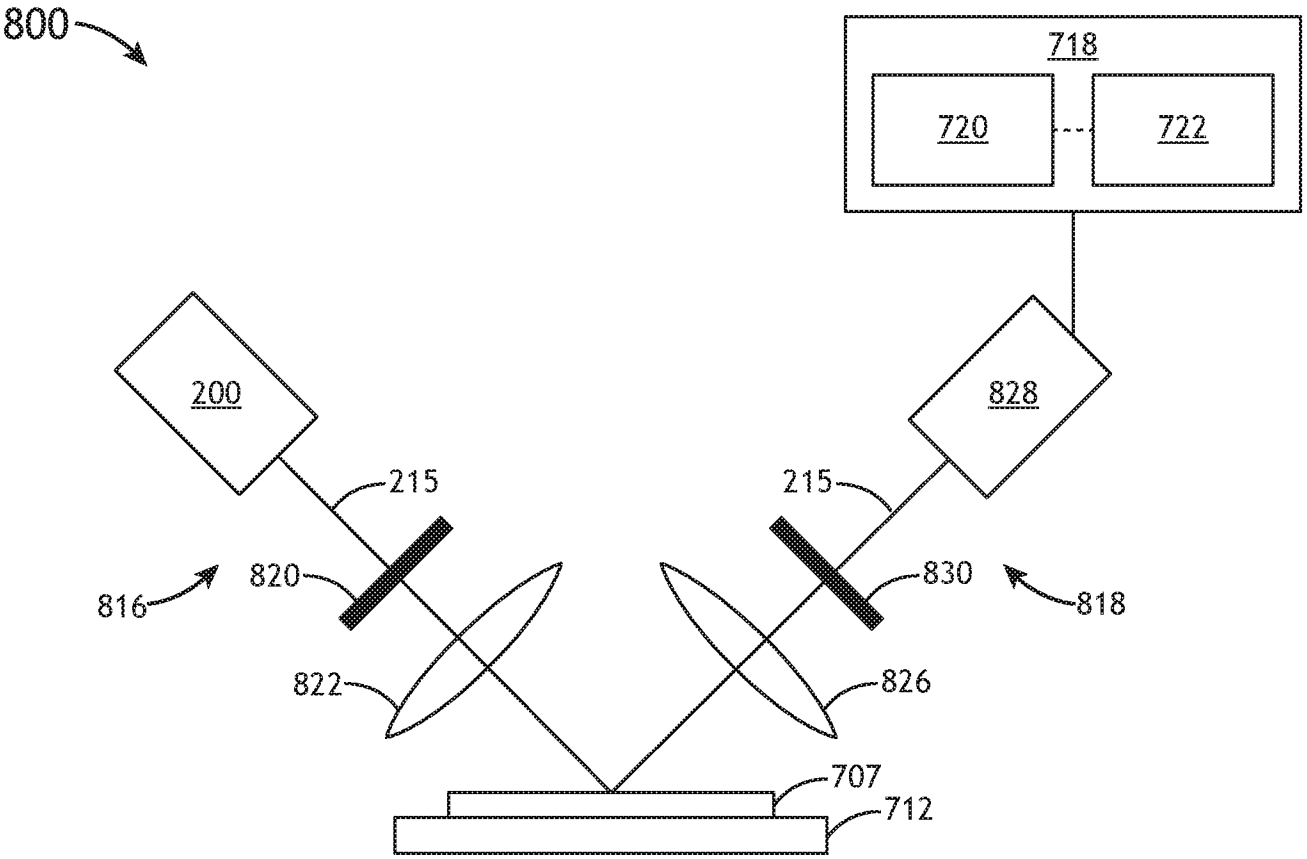
FIG. 8 illustrates a simplified schematic diagram of an optical characterization system arranged in a reflectometry and/or ellipsometry configuration in accordance with one or more embodiments of the present disclosure.

FIG. 8 illustrates a simplified schematic diagram of an optical characterization system 800 arranged in a reflectometry and/or ellipsometry configuration, in accordance with one or more embodiments of the present disclosure. It is noted that the various embodiments and components described with respect to FIGS. 2A though 7 may be interpreted to extend to the system of FIG. 8. The system 800 may include any type of metrology system known in the art.

In one embodiment, system 800 includes the LSP broadband light source 200, an illumination arm 816, a collection arm 818, a detector assembly 828, and the controller 718 including the one or more processors 720 and memory 722.

In this embodiment, the broadband illumination from the LSP broadband light source 200 is directed to the specimen 707 via the illumination arm 816. In another embodiment, the system 800 collects illumination emanating from the sample via the collection arm 818. The illumination arm pathway 816 may include one or more beam conditioning components 820 suitable for modifying and/or conditioning the broadband beam. For example, the one or more beam conditioning components 820 may include, but are not limited to, one or more polarizers, one or more filters, one or more beam splitters, one or more diffusers, one or more homogenizers, one or more apodizers, one or more beam shapers, or one or more lenses.

In another embodiment, the illumination arm 816 may utilize a first focusing element 822 to focus and/or direct the beam onto the specimen 207 disposed on the sample stage 712. In another embodiment, the collection arm 818 may include a second focusing element 826 to collect illumination from the specimen 707.

In another embodiment, the detector assembly 828 is configured to capture illumination emanating from the specimen 707 through the collection arm 818. For example, the detector assembly 828 may receive illumination reflected or scattered (e.g., via specular reflection, diffuse reflection, and the like) from the specimen 707. By way of another example, the detector assembly 828 may receive illumination generated by the specimen 707 (e.g., luminescence associated with absorption of the beam, and the like). It is noted that detector assembly 828 may include any sensor and detector assembly known in the art. For example, the sensor may include, but is not limited to, CCD detector, a CMOS detector, a TDI detector, a PMT, an APD, and the like.

The collection arm 818 may further include any number of collection beam conditioning elements 830 to direct and/or modify illumination collected by the second focusing element 826 including, but not limited to, one or more lenses, one or more filters, one or more polarizers, or one or more phase plates.

The system 800 may be configured as any type of metrology tool known in the art such as, but not limited to, a spectroscopic ellipsometer with one or more angles of illumination, a spectroscopic ellipsometer for measuring Mueller matrix elements (e.g., using rotating compensators), a single-wavelength ellipsometer, an angle-resolved ellipsometer (e.g., a beam-profile ellipsometer), a spectroscopic reflectometer, a single-wavelength reflectometer, an angle-resolved reflectometer (e.g., a beam-profile reflectometer), an imaging system, a pupil imaging system, a spectral imaging system, or a scatterometer.

A description of an inspection/metrology tools suitable for implementation in the various embodiments of the present disclosure are provided in U.S. patent application Ser. No. 13/554,954, entitled "Wafer Inspection System," filed on Jul. 9, 2012; U.S. Published Patent Application 2009/0180176, entitled "Split Field Inspection System Using Small Catadioptric Objectives," published on Jul. 16, 2009; U.S. Published Patent Application 2007/0002465, entitled "Beam Delivery System for Laser Dark-Field Illumination in a Catadioptric Optical System," published on Jan. 4, 2007; U.S. Pat. No. 5,999,310, entitled "Ultra-broadband UV Microscope Imaging System with Wide Range Zoom Capability," issued on Dec. 7, 1999; U.S. Pat. No. 7,525,649 entitled "Surface Inspection System Using Laser Line Illumination with Two Dimensional Imaging," issued on Apr. 28, 2009; U.S. Published Patent Application 2013/0114085, entitled "Dynamically Adjustable Semiconductor Metrology System," by Wang et al. and published on May 9, 2013; U.S. Pat. No. 5,608,526, entitled "Focused Beam Spectroscopic Ellipsometry Method and System, by Piwonka-Corle et al., issued on Mar. 4, 1997; and U.S. Pat. No. 6,297,880, entitled "Apparatus for Analyzing Multi-Layer Thin Film Stacks on Semiconductors," by Rosencwaig et al., issued on Oct. 2, 2001, which are each incorporated herein by reference in their entirety.

The one or more processors 720 of the present disclosure may include any one or more processing elements known in the art. In this sense, the one or more processors 720 may include any microprocessor-type device configured to execute software algorithms and/or instructions. It should be recognized that the steps described throughout the present disclosure may be carried out by a single computer system or, alternatively, multiple computer systems. In general, the term "processor" may be broadly defined to encompass any device having one or more processing and/or logic elements, which execute program instructions from a non-transitory memory medium 722. Moreover, different subsystems of the various systems disclosed may include processor and/or logic elements suitable for carrying out at least a portion of the steps described throughout the present disclosure.

The memory medium 722 may include any storage medium known in the art suitable for storing program instructions executable by the associated one or more processors 720. For example, the memory medium 722 may include a non-transitory memory medium. For instance, the memory medium 722 may include, but is not limited to, a read-only memory, a random-access memory, a magnetic or optical memory device (e.g., disk), a magnetic tape, a solid-state drive, and the like. In another embodiment, the memory 722 is configured to store one or more results and/or outputs of the various steps described herein. It is further noted that memory 722 may be housed in a common controller housing with the one or more processors 720. In an alternative embodiment, the memory 722 may be located remotely with respect to the physical location of the one or more processors 720. For instance, the one or more processors 720 may access a remote memory (e.g., server), accessible through a network (e.g., internet, intranet, and the like). In this regard, the one or more processors 720 of the controller 718 may execute any of the various process steps described throughout the present disclosure. It is noted herein that the one or more components of system 700 may be communicatively coupled to the various other components of system 700 in any manner known in the art. For example, the illumination system 700, detector assembly 714, controller 718, and one or more processors 720 may be communicatively coupled to each other and other components via a wireline (e.g., copper wire, fiber optic cable, and the like) or wireless connection (e.g., RF coupling, IR coupling, data network communication (e.g., WiFi, WiMax, Bluetooth and the like).

In some embodiments, the LSP broadband light source 200 and systems 700, 800, as described herein, may be configured as a "stand alone tool," interpreted herein as a tool that is not physically coupled to a process tool. In other embodiments, such an inspection or metrology system may be coupled to a process tool (not shown) by a transmission medium, which may include wired and/or wireless portions. The process tool may include any process tool known in the art such as a lithography tool, an etch tool, a deposition tool, a polishing tool, a plating tool, a cleaning tool, or an ion implantation tool. The results of inspection or measurement performed by the systems described herein may be used to alter a parameter of a process or a process tool using a feedback control technique, a feedforward control technique, and/or an in-situ control technique. The parameter of the process or the process tool may be altered manually or automatically.

Figure 9:
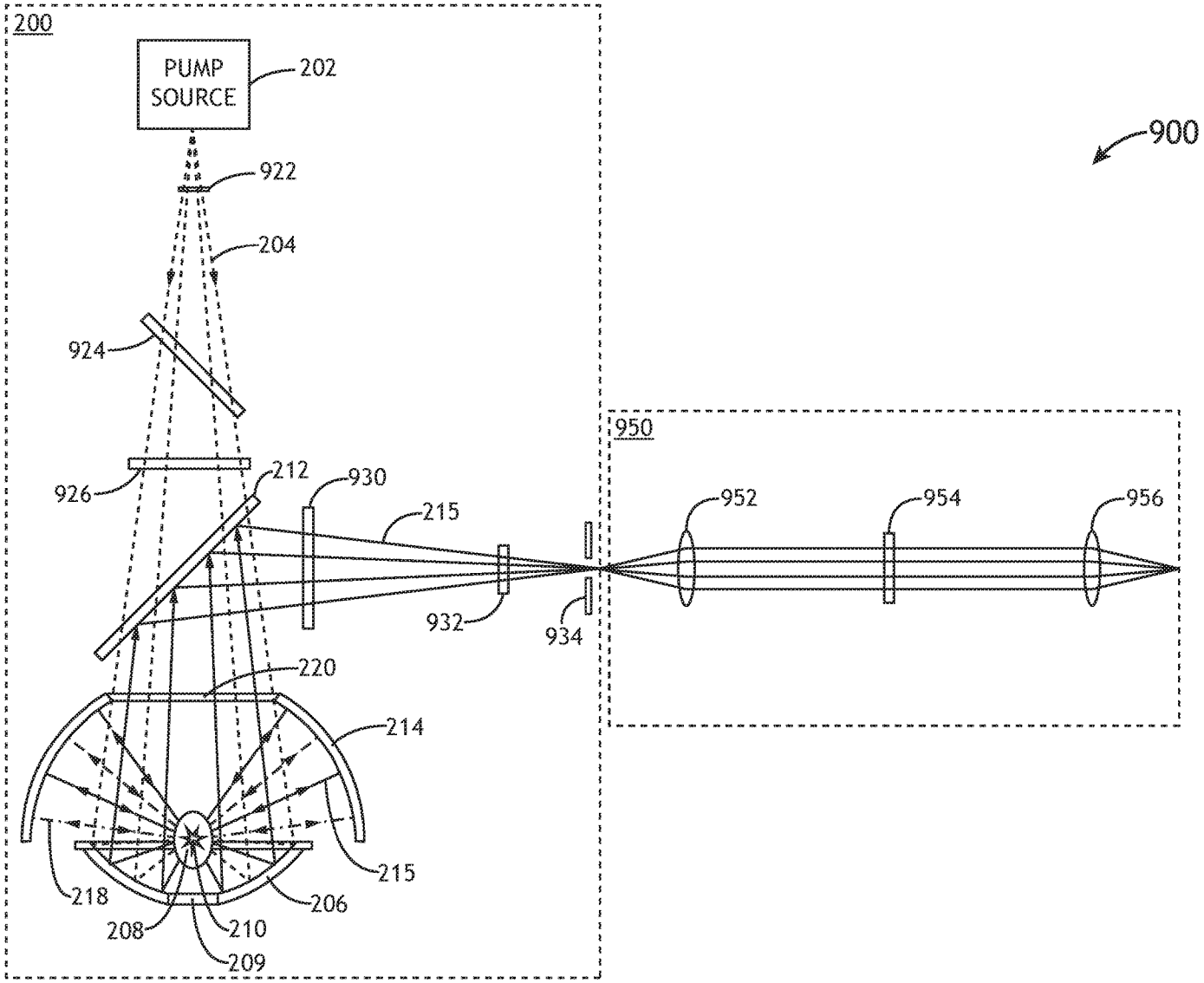
FIG. 9 is a schematic illustration of an optical characterization system implementing an LSP broadband light source, such as the LSP broadband light source illustrated in any of FIGS. 2A through 8, or any combination thereof, in accordance with one or more embodiments of the present disclosure.

FIG. 9 is a schematic illustration of an optical characterization system 900 implementing LSP broadband light source 200, such as the LSP broadband light source illustrated in any of FIGS. 2A through 8, or any combination thereof, in accordance with one or more embodiments of the present disclosure. In one embodiment, the system 900 includes an illuminator arm 950 coupled to a collection aperture 934 for receiving broadband light 215 from the broadband light source 200. It is noted that the illumination arm 950 may serve as the illuminator for any inspection, metrology, or other imaging system known in the art and is provided herein for illustrative purposes only.

In another embodiment, the system 900 includes a NA lens 922, a compensating plate 924, and a cylinder lens 926 along the illumination pathway (i.e., the pathway of the pump illumination 204). In addition, the system 900 includes a window 930 and color filter (CF) 932 along the collection pathway 217 (i.e., the pathway of the broadband light 215).

In one embodiment, the illuminator arm 950 includes one or more components for shaping and/or conditioning the broadband light 215. For example, the one or more components may include one or more lenses 952, 956, one or more mirrors, one or more filters, or one or more beam shaping elements 954 (e.g., homogenizer, beam shaper, or the like) to provide a selected illumination condition (e.g., illumination field size, beam shape, angle, spectral content, or the like).

Figure 10:
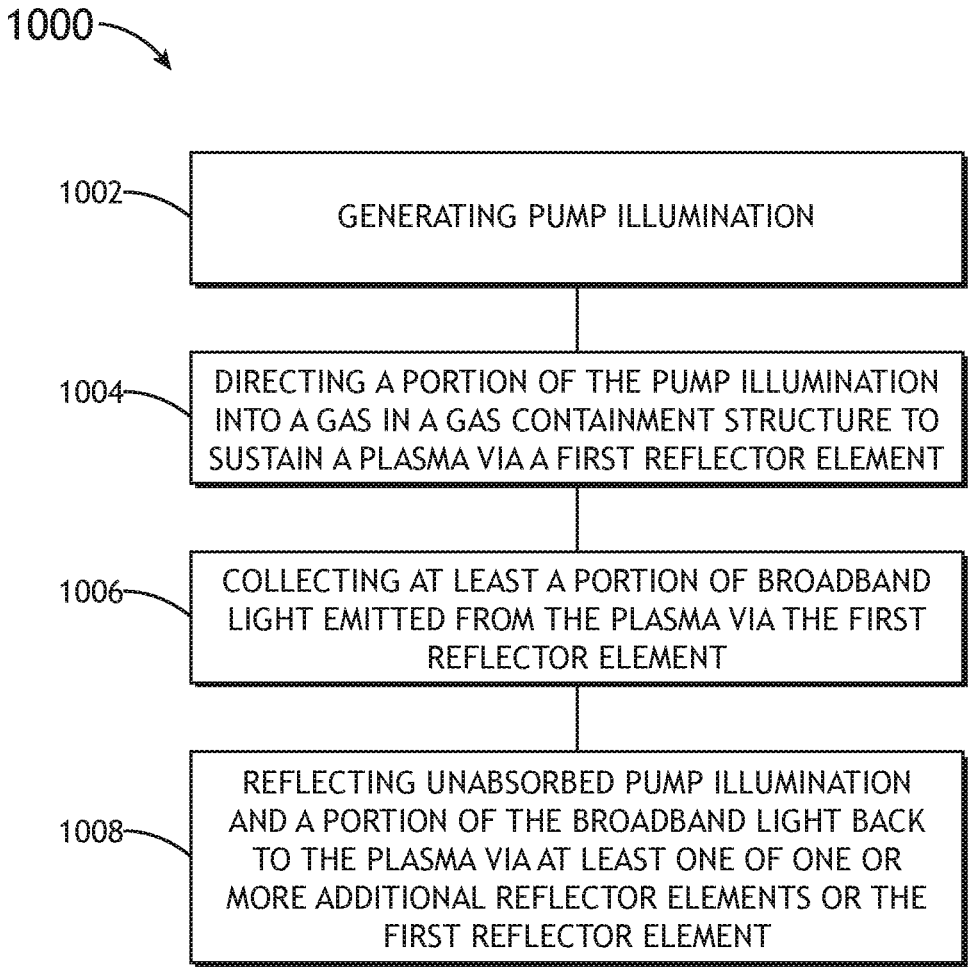
FIG. 10 is a flow diagram illustrating a method for implementing an LSP broadband light source, in accordance with one or more embodiments of the present disclosure.

FIG. 10 is a flow diagram illustrating a method 1000 for implementing the LSP broadband light source 200-800, in accordance with one or more embodiments of the present disclosure. It is noted herein that the steps of method 1000 may be implemented all or in part by broadband light source 200 and/or systems 700, 800, or 900. It is further recognized, however, that the method 1000 is not limited to the broadband light source 200 and/or systems 700, 800, or 900 in that additional or alternative system-level embodiments may carry out all or part of the steps of method 1000.

In a step 1002, a pump source generates pump illumination.

In a step 1004, a first reflector element is configured to direct a portion of the pump illumination into a gas in a gas containment structure to sustain a plasma.

In a step 1006, the first reflector element collects a portion of broadband light emitted from the plasma and directs the portion of broadband light to one or more downstream applications. The one or more downstream applications may include at least one of inspection or metrology.

In a step 1008, one or more additional reflector elements are configured to reflect unabsorbed pump illumination and broadband light uncollected by the first reflector element back to the plasma.

During operation, the pump source 202 generates pump illumination 204. The first reflector element 206 directs the pump illumination 204 into the gas containment structure 208 to sustain the plasma 210. The plasma 210 emits broadband light 215, which is collected by the first reflector element 206 and the first reflector element 206 directs the broadband light 215 to one or more downstream applications (e.g., metrology or inspection). One or more additional optics may aid in directing the broadband light 215 to the one or more downstream applications. The one or more additional reflector elements 214 reflect the unabsorbed pump illumination and broadband light uncollected by the first reflector element 206 back to the plasma 210 to further heat up the plasma. The plasma 210 absorbs a portion of the pump illumination 204 and emits broadband radiation 215, which is also re-focused back to the plasma 210 to heat up the plasma.

One skilled in the art will recognize that the herein described components, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, devices, and objects should not be taken as limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed:

1. A system comprising:

a gas containment structure for containing a gas;

a pump source configured to generate pump illumination;

a first reflector element configured to direct a portion of the pump illumination into the gas to sustain a plasma, wherein the first reflector is configured to collect at least a portion of broadband light emitted from the plasma; and one or more additional reflector elements positioned opposite of the first reflector, wherein a reflective surface of the first reflector element faces a reflective surface of the one or more additional reflector elements, wherein the one or more additional reflector elements are configured to reflect unabsorbed pump illumination and broadband light uncollected by the first reflector element back to the plasma.

2. The system of claim 1, wherein the one or more additional reflector elements are configured to reflect a portion of upper $2\pi$ light that is uncollected by the first reflector element.

3. The system of claim 2, wherein the one or more additional reflector elements are configured to focus the portion of the upper $2\pi$ light to a first foci of the first reflector element.

4. The system of claim 3, wherein a portion of the upper $2\pi$ light is further relayed to a second foci of the first reflector element.

5. The system of claim 1, wherein the first reflector element comprises a reflective elliptical section.

6. The system of claim 1, wherein the one or more additional reflector elements comprise one or more reflective spherical sections.

7. The system of claim 6, wherein the one or more additional reflector elements comprise a single reflective spherical section.

8. The system of claim 6, wherein the one or more additional reflector elements comprise: a first reflective spherical section and a second spherical section, wherein a radius of curvature of the first reflective spherical section is less than a radius of curvature of the second spherical section.

9. The system of claim 1, wherein the first reflector element has a radius of curvature smaller than a radius of curvature of the one or more additional reflector elements.

10. The system of claim 1, wherein the first reflector element has a radius of curvature larger than a radius of curvature of the one or more additional reflector elements.

11. The system of claim 1, wherein the first reflector element and the one or more additional reflector elements have a combined collection solid angle between $3\pi$ and $4\pi$.

12. The system of claim 11, wherein the first reflector element and the one or more additional reflector elements have a combined collection solid angle between $3.4\pi$ and $3.6\pi$.

13. The system of claim 1, wherein the one or more additional reflector elements are positioned above the first reflector element.

14. The system of claim 1, wherein the one or more additional reflector elements include an aperture configured to pass pump illumination from the pump source to the plasma.

15. The system of claim 1, wherein the pump source comprises:

one or more lasers.

16. The system of claim 15, wherein the pump source comprises:

at least one of an infrared laser, a visible laser, or an ultraviolet laser.

17. The system of claim 1, wherein the first reflector element and the one or more additional elements are configured to collect at least one of broadband UV, VUV, DUV, or EUV light from the plasma.

18. The system of claim 1, wherein the gas comprises:

at least one of argon, krypton, or xenon.

19. The system of claim 1, wherein the gas containment structure comprises:

at least one of a plasma bulb, a plasma cell, or a plasma chamber.

20. The system of claim 1, further comprising: one or more additional collection optics configured to direct a broadband light output from the plasma to one or more downstream applications.

21. The system of claim 20, wherein the one or more downstream applications comprises: at least one of inspection or metrology.

22. A system comprising:

a gas containment structure for containing a gas;

a pump source configured to generate pump illumination;

an elliptical mirror configured to direct a portion of the pump illumination into the gas to sustain a plasma, wherein the elliptical mirror is configured to collect at least a portion of broadband light emitted from the plasma and direct the portion of broadband light to one or more downstream applications; and one or more spherical mirrors positioned above the elliptical mirror, wherein a reflective surface of the elliptical mirror faces a reflective surface of the one or more spherical mirrors, wherein the one or more spherical mirrors are configured to reflect unabsorbed pump illumination and broadband light uncollected by the elliptical mirror back to the plasma.

23. A method comprising:

generating pump illumination;

directing a portion of the pump illumination into a gas in a gas containment structure to sustain a plasma via a first reflector element;

collecting a portion of broadband light emitted from the plasma via the first reflector element and directing the portion of broadband light to one or more downstream applications; and reflecting unabsorbed pump illumination and broadband light uncollected by the first reflector element back to the plasma via one or more additional reflector elements.

24. The method of claim 23, wherein the one or more downstream applications comprise: at least one of inspection or metrology.

* * * * *